US005100073A

United States Patent [19]

Moehrke et al.

[11] Patent Number: 5,100,073

[45] Date of Patent: Mar. 31, 1992

[54] AUTOMATIC TEXTILE WINDING APPARATUS

[75] Inventors: Dieter Moehrke, Moenchengladbach; Gregor Kathke, Viersen, both of Fed. Rep. of Germany

[73] Assignee: W. Schlafhorst AG & Co., Moenchengladbach, Fed. Rep. of Germany

[21] Appl. No.: 644,709

[22] Filed: Jan. 23, 1991

[30] Foreign Application Priority Data

Jan. 29, 1990 [DE] Fed. Rep. of Germany ..... 4002500

[51] Int. Cl.[5] ..... B65H 63/00; B65H 67/02

[52] U.S. Cl. ..... 242/36; 242/35.50 R; 242/35.50 A; 73/160; 57/281

[58] Field of Search ..... 242/36, 35.5 A, 35.5 R, 242/35.6 R, 18 R, 1; 57/281, 264, 265, 266; 73/160, 159

[56] References Cited

U.S. PATENT DOCUMENTS

| | | | |
|---|---|---|---|
| 3,263,499 | 8/1966 | Gith et al. | 73/160 |
| 4,660,370 | 4/1987 | Matsui et al. | 57/281 |
| 4,838,019 | 6/1989 | Ueda | 242/35.5 A X |
| 4,843,808 | 7/1989 | Ruege et al. | 242/35.5 A X |
| 4,854,439 | 8/1989 | Ueda | 242/35.5 A X |

FOREIGN PATENT DOCUMENTS

| | | |
|---|---|---|
| 3732367A1 | 11/1988 | Fed. Rep. of Germany . |
| 3920181 | 8/1989 | Fed. Rep. of Germany . |
| 38158800A1 | 11/1989 | Fed. Rep. of Germany . |

*Primary Examiner*—Stanley N. Gilreath
*Attorney, Agent, or Firm*—Shefte, Pinckney & Sawyer

[57] ABSTRACT

In an automatic textile winder, an origination indicia is associated with each spinning tube supplied to the winder, e.g., in the form of a label, marking, or the like, on or applied to each tube or to a peg-tray carrier therefor. A quality-control device is provided at each winding station to monitor a quality-related parameter of the yarn winding operation. Another device is provided at each winding station in operative association with the respective quality control device for cancelling the indicia of each spinning tube whose yarn satisfies a predetermined value for the quality-related parameter as determined by the quality-control device, but leaving uncancelled the indicia of any spinning tube whose yarn fails to satisfy such quality value. Each spinning tube discharged from the winding stations is delivered to a detection station for reading or otherwise detecting any indicia remaining thereon. In this manner, the origin of inferior or sub-quality yarn can be readily identified.

10 Claims, 2 Drawing Sheets

AUTOMATIC TEXTILE WINDING APPARATUS

BACKGROUND OF THE INVENTION

The present invention relates generally to automatic winding apparatus of the type utilized for winding yarn from spinning tubes onto another yarn package, typically in a cross-winding manner. More particularly, the present invention relates to automatic textile winders of the aforementioned type wherein yarn spinning tubes or carriers therefor are provided with a marking or other indicia identifying the origin of the yarn thereon and wherein the winding apparatus is equipped with a device or means for continuously monitoring a quality-related parameter of the winding operation.

West German patent document DE 37 32 367 A1 discloses the provision of a textile spinning tube or bobbin with a memory chip carrying binary information relevant for the processing of yarn on the tube or bobbin at a subsequent processing station whereat the stored information is read, decoded, processed to attain operating instructions or to automatically control station operation, and optionally erased and replaced with or supplemented by other or further binary information. The technical expense associated with such arrangement at the processing stations is considerable.

SUMMARY OF THE INVENTION

It is an object of the present invention to provide an inexpensive means by which the origin of yarn on spinning tubes delivered to the winding stations of an automatic textile winder can be identified when quality-related problems are experienced with the yarn during the winding operation.

Yarn quality problems can have various causes, but typically can be traced to the origin of the yarn, e.g., the spinning position of a spinning machine at which the yarn was produced and wound onto a supporting tube or bobbin.

Thus, according to the present invention, each spinning tube supplied to the present automatic textile winding apparatus has an associated origination indicia which indicates the origin of the yarn on the tube. Each of the multiple winding stations of the winding apparatus has a quality-control device which continuously monitors a quality-related parameter of the yarn winding operation and also has an associated device for selectively cancelling the origination indicia of spinning tubes which are unwound at the winding station. The indicia-cancelling device is selectively de-actuated so as not to operate on any spinning tube whose yarn fails to satisfy a predetermined value or criteria for the quality-related parameter, as determined by the quality-control device. Thus, only spinning tubes which carried yarn of inferior quality still retain their associated origination indicia following completion of the yarn winding operation, which facilitates analysis as to the origin of the inferior quality yarn.

It will be readily apparent that such an origination indicia may be of any of varying forms. In each case, a suitable device for cancelling the indicia may be relatively simple and inexpensive. Further, the analysis of origination indicia which remain on unwound spinning tubes after the winding operation may also, in principle, be performed simply and inexpensively, e.g., by delivering all spent spinning tubes to a central or common detection station for inspection and identification as to any origination indicia remaining thereon. Any such spinning tubes may be separated for handling by operating personnel.

The origination indicia may be placed on the spinning tubes or on carriers for the spinning tubes, such as conventional tube-supporting peg trays. A simple form of origination indicia may be a number-bearing adhesive label, in which case the indicia-cancelling device may be adapted to remove or otherwise cancel the label. Typically, the indicia on only a relatively small number of yarn tubes or carriers will remain after operation of the indicia-cancelling device. With this simple form of labeling, such yarn tubes or carriers may be readily noticed visually in the course of further processing, enabling the origin of their yarn to be readily determined simply by visual observation.

On the other hand, it will be desirable in most cases to automate the recognition of spent spinning tubes or their carriers on which origination indicia remain. For this purpose, spent spinning tubes may be removed from each winding station onto a common discharge conveyor, with an indicia-reading device being provided along the discharge conveyor capable of recognizing indicia remaining on the discharged spinning tubes or their carriers. The origin, e.g., spinning station, of each such spinning tube can then be subsequently inspected to enable a determination to be made whether a malfunction or other quality-related problem exists thereat.

It is recognized that an automatically-operated indicia-reading device involves a greater technical complexity and attendant expense than simple observation of a visually recognizable indicia. However, the expense is relatively insignificant in relation to the overall winding system since only a single reading device need be provided along a common discharge conveyor serving multiple winding stations.

In another embodiment, each spinning tube or tube carrier stores its origination indicia by an individual magnetic medium mounted or connected to the tube or carrier. For example, the indicia may be contained as a magnetizing pattern or as a binary piece of information in a magnetizable foil, such as a magnetic recording tape or the like. In such embodiment, the indicia-cancelling device appropriately comprises a selectively actuable and de-actuable magnet controlled by the quality-control device Specifically, for each spinning tube whose yarn meets or exceeds the predetermined quality value, the magnet is actuated or engaged to erase or otherwise cancel the indicia. In contrast, the magnet is de-actuated or disengaged for any tube or carrier whose yarn fails to meet the quality value, whereby the indicia remains. For this purpose, each indicia-cancelling device may be disposed at its respective spinning station for passage of spent spinning tubes or their tube carriers y the device following each tube replacement operation.

In an alternative embodiment, each spinning tube or tube carrier may be provided with a chargeable or codeable and cancellable electronic memory chip comprising semi-conductor componentry and integrated circuitry. In such embodiment, each indicia-cancelling device comprises an erasing head for cancelling the storage content of the memory chip, activation and deactivation of the erasing head being controlled by the quality-control device.

Memory chips of the aforedescribed type are conventionally available as adhesive platelets of only a few millimeters in thickness, so that such memory chips can be economically utilized for the purposes of the present invention. Advantageously, memory chips of this type may have erasable and programmable memories, e.g., an EPROM or EEPROM.

Alternatively, the memory chips may have a battery-buffered main memory, e.g., a RAM, in which case the indicia-cancelling device appropriately comprises a device for rendering the battery buffering inoperable at least temporarily, the actuation and de-actuation of such device being controlled by the quality-control device. If the battery buffering becomes inoperative even for only a brief period of time, the main memory loses its stored information, making it possible to achieve the purpose of the present invention.

The battery buffering in this embodiment can be rendered inoperative in various ways. For example, the battery-buffered main memory may comprise a switching element operatively connected, either in series to or in parallel with the buffered battery, the switching state or the resistance of the switching element being changeable by the presence or absence of an external source of energy. Accordingly, in such case, the indicia-cancelling device may comprise a selectively actuable and de-actuable energy transmitter controlled by the quality-control device. More particularly, the switching element may comprise a switch (e.g., a reed contact) or a resistor or other element (e.g. field plate or HALL element) which is sensitive to magnetic fields and the energy transmitter may comprise an electromagnet.

Alternatively, the switching element may comprise an energy-sensitive switch, resistor, or element, such as a transistor or diode. For example, a light-sensitive element, such as a phototransistor, a photodiode, or a photoelement may be utilized. In such case, the energy transmitter may comprise a light transmitter which is actuable and de-actuable by the quality-control device.

In a simple embodiment, the battery-buffered main memory has a switch in series or parallel with the buffered battery, which switch is changeable by a switching pin which is extendable as a feeler from the indicia-cancelling device. Such a switch-changing operation of the switching element briefly bridges the buffer battery in parallel connection or circuit so that the battery is short-circuited, if necessary via resistor, or the battery current is briefly interrupted.

DESCRIPTION OF THE PREFERRED EMBODIMENT

Figure 1:
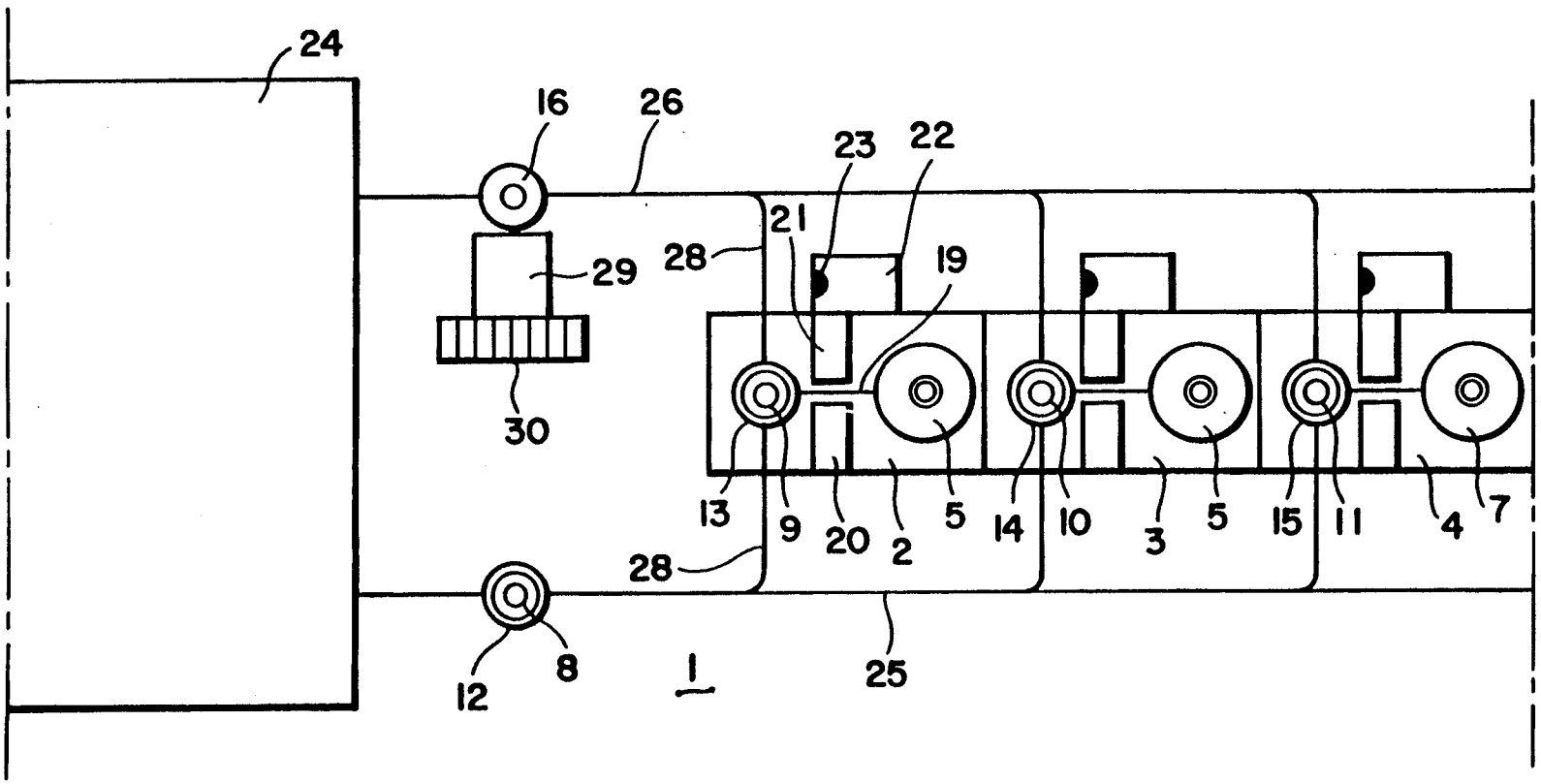
FIG. 1 is a schematic top plan view of an automatic textile winding apparatus according to the preferred embodiment of the present invention.

Referring now to the accompanying drawings and initially to FIG. 1 an automatic textile winding apparatus is schematically shown generally at 1, the winder 1 having a plurality of winding stations, only three of which are shown for simplicity of illustration as winding heads 2, 3, 4. As will be understood, the construction and operation of the winding head at each winding station is identical. In conventional fashion, each winding head 2, 3, 4 is basically operable to unwind yarn (e.g., yarn 19) from a spinning tube 9, 10, 11 and rewind the yarn in a cross-wound fashion onto a larger bobbin or package 5, 6, 7. The spinning tubes 9, 10, are supported on tube carriers 13, 14, 15, preferably of the peg-tray type representatively shown by carrier 16 of FIG. 2. Such peg-tray carriers consist of a circular disc-shaped base or pallet having an upstanding central mounting pin or post 18 on which a spinning tube may be telescopically mounted.

Spinning tubes supported on peg-tray carriers are transported to and from the winding stations 2, 3, 4 by a conventional conveyor system which basically includes a supply conveyor 25 extending lengthwise along one side of the winding stations 2, 3, 4, a similar return conveyor 26 extending lengthwise along the opposite side of the winding stations 2, 3, 4, and a plurality of individual branch conveyors extending transversely between the supply and return conveyors 25, 26, one branch conveyor being provided at each winding station, as represented by branch conveyor 28 for winding station 2. Preferably, the supply conveyor 25 originates from, and the return conveyor 26 terminates at, a common tube preparing and loading station, only representatively indicated at 24, whereat spinning tubes fully wound with yarn are placed onto the peg-tray carriers and provided with a suitable indicia as to the origin of their yarns in accordance with the present invention as hereinafter more fully described. If desired, the station 24 may be a spinning machine or otherwise set up itself to produce the spinning tubes, although such function is of secondary importance with respect to the present invention. By way of example, such a compound spinning/winding machine combination is representatively disclosed in German patent document DE 37 12 654, which corresponds to U.S. Pat. No. 4,843,808.

As shown in FIG. 1, fully-wound spinning tubes mounted on respective peg-tray carriers, such as representatively indicated by spinning tube 8 supported on peg-tray carrier 12, are transported from the preparing and loading station 24 along supply conveyor 25 to the branch conveyors which transfer each peg-tray mounted spinning tube, as needed, to a winding station When the yarn on a spinning tube is fully unwound at a winding station, the peg-tray mounted spinning tube is then transported by the associated branch conveyor to the return conveyor 26, which transports the peg-tray mounted empty tube back to the preparing and loading station 24.

As will be understood, several spinning tubes are required to form a single cross-wound bobbin. For this reason, and because it is desirable to maintain the winding speed at each winding station as high as possible, each individual winding head includes a yarn splicing or piecing device 20 which is automatically operative upon each replacement of a spent spinning tube with a new fully-wound spinning tube to splice or otherwise join the trailing end of yarn unwound from each spinning tube to the leading end of yarn from the next succeeding spinning tube to be unwound, thereby to minimize interruptions in the winding operation.

Each winding station also includes a quality-control device, only schematically indicated at 21 at winding station 2, preferably in the form of a yarn cleaner which is adapted, in generally conventional fashion, to continuously monitor the yarn 19 for defects or irregularities as it is unwound from each spinning tube to cut out defective or irregular sections of yarn when detected, to initiate a splicing or piecing operation following each such cutting operation, to count the number of such cutting operations for each spinning tube, and compare such number against a pre-established standard, and additionally to determine the time interval between successive cuts and compare such time period with a pre-established standard. As will be understood, the yarn on any given spinning tube is considered to be of unacceptable or inferior quality when it is necessary to perform a greater number of cuts for defective or irregular yarn sections than the pre-established standard or when such cuts occur at a more frequent time interval than the pre-established standard.

Figure 2:
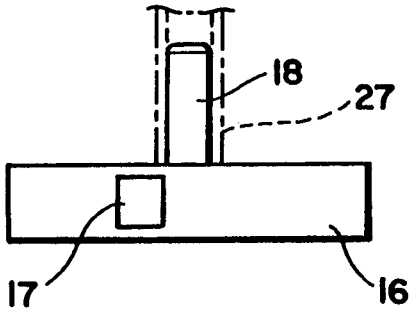
FIG. 2 is a side elevational view of a peg-tray type of spinning tube carrier for use in the present winding apparatus of FIG. 1.

The present invention provides a means to facilitate the investigation and evaluation of the cause of unacceptable or inferior quality yarn by enabling the origin of defective yarn, e.g., the spinning machine and spinning station whereat the yarn was produced, to be readily identified. Basically, in accordance with the present invention, an origination indicia is associated with each spinning tube, 8, 9, !0, 11 delivered from the tube preparing and loading station 24 to the winding stations of the winder 1 indicative of the origin of the yarn carried on the tube. The origination indicia may be carried on the spinning tube itself, or more preferably, on the tube carrier 12, 13, 14, 15, as representatively shown in FIG. 2 by indicia 17 on peg-tray carrier 16. As more fully explained below, the origination indicia 17 may be of various forms, the indicia 17 of FIG. 2 representing an embodiment wherein the indicia is stored in an electronic memory chip, which includes semi-conductor components and integrated circuitry, affixed to the outer periphery of the base of peg-tray carrier 16.

Each winding station of the winder 1 is provided with an indicia-cancelling device, only representatively indicated at 22, which is operatively controlled by the quality-control device 21 to remove, erase, or otherwise cancel the origination indicia 17 of only the spinning tubes whose yarn satisfies the pre-established quality standards during the course of yarn unwinding therefrom. Basically, each indicia-cancelling device 22 is equipped with a cancelling head 23 disposed alongside the discharge portion of the branch conveyor (e.g., conveyor 28) for the associated winding station for selectively acting on each spent spinning tube discharged from the associated winding station. Preferably, the cancelling head 23 is normally continuously actuated or engaged to remove, erase, or otherwise cancel the origination indicia 17 of each spinning tube traveling past the cancellation head 23. However, when the associated quality-control device 21 of the winding station determines that the yarn (e.g., yarn 19) being unwound from a spinning tube is of inferior or unacceptable quality, i.e., the yarn fails to satisfy the pre-established quality standards monitored by the quality-control device 21 (e.g., the yarn has an excessive number of defective or irregular sections which require removal or an unacceptable high frequency of defective or irregular sections), the quality-control device 21 deactuates or disengages the cancelling head 23 temporarily while the spinning tube in question is discharged from the winding station along the associated branch conveyor, whereby the peg-tray carrier for the spinning tube retains its origination indicia after discharge to the return conveyor 26.

In this manner, only the peg-tray carriers for spinning tubes whose yarn was determined to be of inferior or unacceptable quality at the winding station still retain an origination indicia after discharge to the return conveyor 26. Typically, the number of such peg-tray carriers will be relatively low in comparison to the overall number of peg-tray carriers and spinning tubes discharged from the multiple winding stations of the winder 1. In any event, the origin of each defective yarn can subsequently be identified readily from the remaining origination indicia 17 on the associated peg-tray carriers 16, for example, by a suitable conventional indicia reading device 29 which may advantageously be located alongside the common return conveyor 26 as indicated in FIG. 1. Preferably, the reading device 29 is provided with an indicator 30 to display or otherwise indicate appropriate information regarding each indicia remaining on the discharged carriers, e.g., a number designating the origin of the previously-carried yarn.

As an alternative to the use of a memory chip 17 for storing the origination indicia, various other forms of indicia may be utilized. For example, in its simplest form, the origination indicia could merely be an adhesive label or similar data carrier bearing a number or other marking, such as a bar code or binary code marking. In such case, the cancelling head 23 of the indicia-cancelling device 22 would be configured or arranged for rendering such number or marking illegible, or, alternatively, for removing the label or other data carrier, on each peg-tray carrier whose yarn is determined by the quality-control device 21 during yarn unwinding to satisfy the pre-established quality-control standard or standards. The indicia-reading device 29 would correspondingly be a suitable device configured or arranged to recognize and identify the number, bar code, or other code or marking on the label or data carrier.

Alternatively, each origination indicia 17 may be stored by an individual magnetic medium, for example, in the form of a magnetization pattern or as binary information in a magnetizable foil affixed or connected to the peg-tray carrier 16. In this case, the indicia-cancelling head 23 of the cancelling device 22 includes a magnet which is operatively controlled by the quality-control device 21 to actuate and de-actuate the magnet to selectively erase or not erase the magnetically stored origination indicia 17.

In the first above-mentioned embodiment wherein the origination indicia 17 is stored in a chargeable or codeable and cancellable electronic memory chip 17 affixed to each peg-tray carrier 16 or other tube carrier, as shown in FIG. 2, such memory chip 17 could, for example, be a conventional EPROM or EEPROM chip or similar electronic device or component having an erasable and programmable memory, such as disclosed in German patent document DE 37 32 367 A1. Alternatively, other possible designs of memory chips are illustrated schematically in FIGS. 3 and 4.

Figure 3:
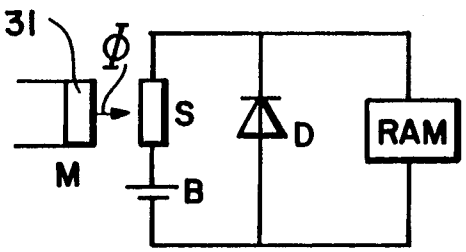
FIG. 3 is a schematic electrical wiring diagram of a memory chip usable in accordance with the present invention for storing yarn origination indicia.

In the memory chip of FIG. 3, a main electronic RAM memory is buffered by a battery B via switching element S with a zener diode D connected in parallel to the main RAM memory. The switching element S includes a switch or other suitable device sensitive to magnetic fields, e.g., a reed contact. Compatibly therewith, the cancelling head 23 of the indicia-cancelling device 22 includes a magnetic energy transmitting device 31, or M, preferably in the form of an electromagnet. Thus, when the electromagnet M is energized, its magnetic stray flux $\phi$ is received by the switching element S which acts as a contact breaker to interrupt the electrical current flowing through the buffering battery B, thereby erasing the memory contents of the main RAM memory.

Alternatively, the switching element S may be an inductive resistor which is operative, when exposed to the stray flux $\phi$ of the electromagnet 31, to increase its inductive resistance in opposition to the buffer battery B, thereby similarly causing the memory buffering effect of the battery B to cease or to become sufficiently weak to change the main RAM memory from a defined into an undefined state so that it loses its memory contents.

Figure 4:
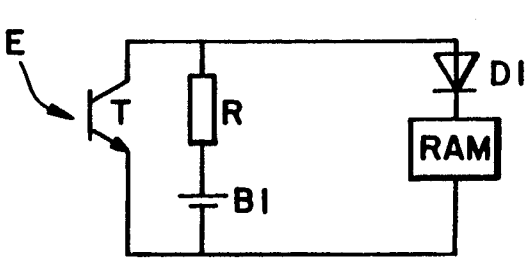
FIG. 4 is a similar schematic electrical wiring diagram of another memory chip usable in accordance with the present invention for storing yarn origination indicia.

In the memory chip of FIG. 4, a main RAM memory is connected via a diode D1 and a resistor R to a buffer battery B1. A transistor T has its collector and emitter connected in parallel to the serial arrangement of the resistor R and buffer battery B1 to arranged the transistor T to function as a energy-sensitive switch. For example, the transistor T may be a phototransistor. In such case, the indicia-cancelling head 23 of the cancelling device 22 may be in the form of a light transmitter operative to direct energy E in the form of a beam of light for causing the transistor T to become conductive and thereby bridge the serial connection of the diode D1 and the main RAM memory. A short circuit thereby results causing the main RAM memory to change from a defined to an undefined state, losing its memory contents.

Of course, those persons skilled in the art will readily recognize that various other forms of origination indicia 17 may be provided on either the peg-tray or other tube carriers or alternatively on the spinning tubes themselves and that, in turn, various other forms of compatible indicia-cancelling devices 22 and indicia-reading devices 29 may be correspondingly utilized. The several above-described embodiments are therefore intended merely to be exemplary of various contemplated embodiments for the present invention, but not to limit the scope of the present invention.

As aforementioned, the function of the tube preparing and loading station 24 may advantageously be performed by a spinning machine arranged in combination with the winding machine 1. In such case, a central computer (not shown) may be provided for compatibly controlling various operational functions of the spinning machine and the winding machine 1 and, in turn, the indicia reading device 29 may advantageously be operatively connected to the main computer to enable it to intervene in the operation of the combined machines in accordance with a predetermined program based upon information obtained by the indicia-reading device 29 from uncancelled origination indicia 17 on the peg-tray carriers or spinning tubes returned to the spinning machine, e.g., to actuate an alarm, de-actuate a spinning station of the spinning machine which is found to be producing inferior or sub-quality yarn, etc.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An automatic textile winding apparatus for winding yarn from spinning tubes onto another yarn package, wherein an origination indicia is associated with each said spinning tube to indicate the origin of the yarn thereon, said winding apparatus comprising a plurality of winding stations, each said winding station having quality-control means for continuously monitoring a quality-related parameter of the yarn winding operation and means for selectively cancelling said origination indicia associated with spinning tubes which are unwound at said winding stations, said indicia-cancelling means being operatively associated with said quality-control means for selective de-actuation of said indicia-cancelling means as to each said spinning tube whose yarn fails to satisfy a predetermined value for said quality-related parameter, whereby said spinning tubes having yarn of inferior quality retain their associated origination indicia following completion of the yarn unwinding operation to enable analysis of the origin of the inferior quality yarn, and a detection station for delivery thereto of said spinning tubes after unwinding at said winding stations for identification of said origination indicia remaining on any said spinning tubes.

2. An automatic textile winding apparatus according to claim 1 and characterized further by a common discharge conveyor for said unwound spinning tubes from each said winding station, said detection station being located along said discharge conveyor.

3. An automatic textile winding apparatus according to claim 1 and characterized further in that each said origination indicia is stored by an individual magnetic medium associated with the respectively associated said spinning tube and each said indicia-cancelling means comprises a selectively actuable and deactuable cancelling magnet controlled by said quality-control means.

4. An automatic textile winding apparatus according to claim 1 and characterized further in that said origination indicia is stored by an individual electronic memory associated with the respectively associated said spinning tube and each said indicia-cancelling means comprises means for erasing said stored origination indicia from said memory chips, said erasing means being controlled by said quality-control means.

5. An automatic textile winding apparatus according to claim 4 and characterized further in that said memory chip contains an erasable programmable memory.

6. An automatic textile winding apparatus according to claim 4 and characterized further in that each said memory chip comprises a battery-buffered main memory and each said indicia-cancelling means comprises means for at least temporarily rendering the battery buffering of said main memory inoperable.

7. An automatic textile winding apparatus according to claim 6 and characterized further in that said battery buffered main memory comprises a switching element operatively connected to the buffered battery, said switching element being changeable between differing states in the presence and absence of an external source of energy, said means for rendering inoperative said battery buffering comprising a selectively actuable and de-actuable energy transmitter.

8. An automatic textile winding apparatus according to claim 7 and characterized further in that said switching element comprises an element which is sensitive to magnetic fields and said energy transmitter comprises an electromagnet.

9. An automatic textile winding apparatus according to claim 7 and characterized further in that said switching element comprises an energy-sensitive switch, resistor, or element.

10. An automatic textile winding apparatus according to claim 9 and characterized further in that said switching element is sensitive to light and said energy transmitter comprises a selectively actuable and de-actuable light transmitter.

* * * * *